United States Patent [19]

Herbst

[11] 3,946,174

[45] Mar. 23, 1976

[54] POSITIVE AND NEGATIVE PRESSURE BREATH CONTROL DEVICE

[76] Inventor: John A. Herbst, 320 South St., Morristown, N.J. 07960

[22] Filed: Sept. 27, 1974

[21] Appl. No.: 509,794

[52] U.S. Cl. ..... 200/81.4; 200/83 C; 200/83 Z; 200/153 T

[51] Int. Cl.[2] ..... H01H 35/32

[58] Field of Search ..... 73/410; 92/34, 35, 37; 340/236, 240; 200/81.4, 153 T, 83 C, 83 Z, 330, 335, 337, 81 H

[56] References Cited

UNITED STATES PATENTS

| | | | |
|---|---|---|---|
| 2,475,069 | 7/1949 | Wood | 200/83 C |
| 2,715,348 | 8/1955 | Williams | 200/81.4 |
| 2,765,743 | 10/1956 | Hollinshead | 200/83 Z |
| 3,676,619 | 7/1972 | Hook | 200/83 Z |
| 3,781,623 | 12/1973 | Neumann | 200/81.4 |

*Primary Examiner*—Gerald P. Tolin

[57] ABSTRACT

This disclosure is directed to a positive and negative pressure operated control device for use as a breath control device. The device includes a plurality of micro switches which can be sequentially actuated or rendered responsive to a person blowing or sucking on an expandible chamber whereby the change in pressure effected thereby will actuate the respective switches accordingly.

8 Claims, 7 Drawing Figures

POSITIVE AND NEGATIVE PRESSURE BREATH CONTROL DEVICE

PROBLEM & PRIOR ART

Many handicapped persons, particularly those who are paralyzed, and/or who have suffered injuries to one or both hands and/or who suffered the loss of both arms or who are quadopedics, and/or are otherwise rendered physically helpless, are dependant upon other persons for their simplest needs, e.g., controlling or directing a wheelchair, turning the pages of a book, etc. Heretofore, efforts have been made to provide such handicapped persons with mechanical aids which can be entirely controlled by the handicapped person himself. Control means for such mechanical aid have been conceived whereby such aids are controlled by touch. However, severely handicapped persons, such as quadrapedics and/or totally paralyzed persons, cannot satisfactory operate such touch type control devices.

OBJECTS

It is an object of this invention to provide a positive and negative pressure sensitive control device whereby mechanical aids can be controlled by a totally handicapped or helpless person.

Another object is to provide a breath control device for a mechanical aid in which a totally paralyzed person can personally control a device by blowing and sucking only.

Another object is to provide a breath control device which is rendered responsive to a plurality of different negative or positive pressure conditions.

Another object is to provide a breath control device in which the mechanical advantage necessary for actuation of the control device is reduced as either the positive or negative pressure respectively is increased.

BRIEF SUMMARY OF THE INVENTION

The foregoing objects and other features and advantages are attained by a pressure sensitive control device which is particularly adapted for use as a breath control device whereby a handicapped person can readily control a mechanical aid. The breath control device comprises essentially of a base member having a lever pivotally connected at one end to the base member. A chamber capable of expanding and contracting is disposed between the base member and the free end of the lever. A suitable hose or conduit is connected in communication with the chamber whereby blowing into the hose causes the chamber to expand and by sucking on the hose causes the chamber to contract. By controlling the air pressure exerted by blowing or sucking the lever is pivoted relative to the base member.

A bracket is mounted on the base and it is provided with an opening. An actuating arm pivotally connected at one end to the lever is extended through the opening, and in the neutral or inoperative position the arm is centered within the opening.

A plurality of micro switches having an actuating plunger are disposed on opposite sides of the actuating arm. The switches are arranged so that a soft blow and hard blow switch are diagonally disposed on opposite sides of the actuating arm. The switches also include a soft suck and a hard suck switch which are also diagonally disposed on opposite sides of the actuating arm. The arragement is such that the hard blow switch functions as the pivot for the actuating arm when the expandible chamber is expanded to a first soft blow position whereby the lever arm provides a mechanical advantage greater than 1, and whereby the bracket because the falcrum or pivot for the actuating arm when the chamber is expanded to a second or hard blow position whereby the lever effect of the actuating arm produces a leverage of 1 to 1. When a negative pressure is applied to the chamber, a converse result is achieved; i.e., a soft suck effects the displacement of the actuating arm with a mechanical advantage greater than 1, and whereby a hard suck effects displacement of the actuating arm with a 1 to 1 mechanical advantage.

FEATURES

A feature of this invention resides in the provision of a breath control device in which appropriate switches are rendered responsive in predetermined sequence in which multiple postive and negative pressure positions are obtainable.

Another feature resides in the provision of a pneumatic control device in which the mechanical advantage of the switch actuator can be varied in a predetermined manner in response to the applied negative or positive pressure.

Other features and advantages will become more readily apparent when consiered in view of the drawings and specifications in which.

DETAILED DESCRIPTION

Figure 3:
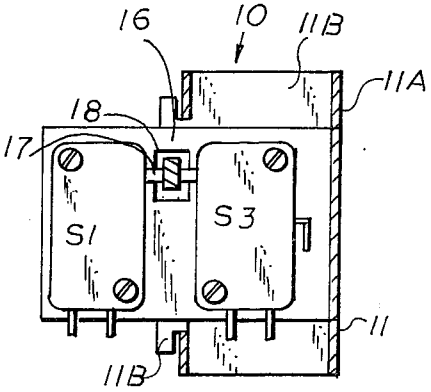
FIG. 3 is a sectional view taken along line 3—3 on FIG. 2.
Figure 4:
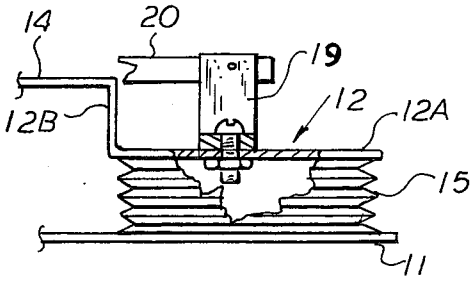
FIG. 4 is an enlarged detail of construction having portions shown in section.

Referring to the drawings, there is shown in FIGS. 1 to 5 a positive and negative pressure sensitive control device 10. The control device is particularly useful as a breath control device for controlling a mechanical aid simply by one's breath; i.e., by a person sucking and blowing. The mechanical aids have reference to wheelchairs, page turning devices and other aids useful to handicapped person. The breath control device 10 is particularly adapted as a control for person who are severely handicapped; e.g., paralyzed persons, quadrapedic and the like. With the control device 10 to be described, a handicapped person can control a particular air; e.g., a wheelchair simply by lowing and sucking on the control device, which it will be understood is operatively connected to the drive of a wheelchair.

Figure 5:
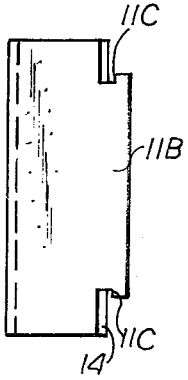
FIG. 5 is an end view taken along line 5—5 on FIG. 3.

The control device 10 comprises a base member 11 having a horizontal leg 11A and a connected vertical leg 11B to define a generally L shaped base. As best seen in FIG. 5, the vertical leg 11B is provided with opposed slots 11C adjacent the upper end thereof. A pivoting lever 12 is pivotally connected to leg portion 11B. As seen in FIGS. 1 to 5, the pivoting lever 12 is pivotally connected to the vertical leg 11B by the interengagement of complementary slots 11C formed in leg 11B and notches 13 formed in the bifurated ends 14—14 of pivot lever 12.

Figure 2:
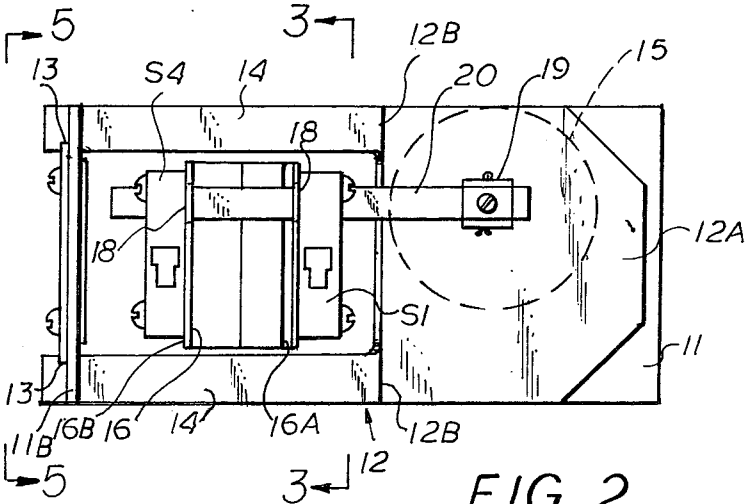
FIG. 2 is a top plan view of FIG. 1.
Figure 1:
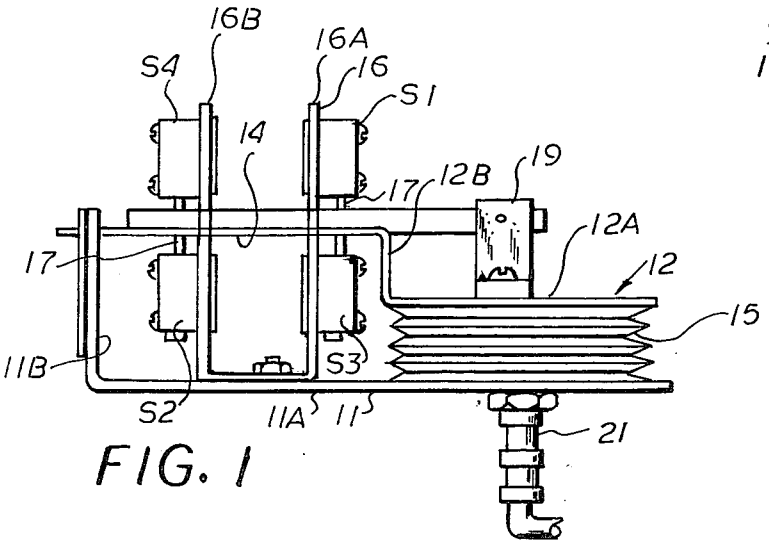
FIG. 1 is a side elevation view of a control device embodying the invention illustrating a plurality of positive pressure conditions.

The pivoting lever 12 includes a free end portion 12A which is connected to an overlie expandible chamber formed in the form of a bellows 15. As best seen in FIGS. 1 and 2, the bifurated ends 14—14 of lever 12 is connected to the free end 12A portion by an offset 12B.

Connected to the base member is a U shaped bracket 16. Mounted on each of the arms 16A, 16B of the bracket 16 are a pair of micro switches $S_1$, $S_2$, $S_3$ and $S_4$ respectively. Each micro switch $S_1$, $S_2$, $S_3$, and $S_4$ is provided with an actuating button or plunger 17 which closes or opens to circuit in which the respective micro switches are connected.

Each arm 16A, 16B of the bracket intermediate the ends thereof is provided with an opening 18 which is disposed in alignment.

On the free end 12A of the pivoting lever 12 there is provided a bracket 19 to which an actuating arm 20 is pivotally connected. As best seen in FIGS. 1 to 3, the actuating arm extends through aligned opening 18, 18 in the arms 16A, 16B of bracket 16 and between the plunger 17 of switches $S_1$ to $S_4$.

In the neutral position as shown in FIG. 2, i.e., when the bellows 15 is neither expanded or contracted, the actuating arm is centered in openings 18, 18 with the plunger 17 of the respective switches $S_1$ to $S_4$ in an inactive or inoperative position.

Connected to the bellows 15 which defines an expandible chamber when subjected to a positive pressure and a collapsed position when subjected to a negative pressure in a hose 21.

The control device 10 described is arranged so as to effect sequential opration of switches $S_1$, $S_2$, $S_3$, and $S_4$ by either one blowing or sucking on hose 21 to subject the chamber or bellows 15 to either a positive or negative pressure.

In accordance with this invention, provisions are provided for the actuation of the control device by either a soft blow or hard blow or by a soft suck or a hard suck, i.e., the control device is rendered responsive to a first or second positive pressure condition or a first or second negative pressure condition. This is attained by subjecting the actuating arm to predetermined mechanical advantages so as to insure positive actuation between the respective position of soft and hard blow position and the soft and hard suck position.

Figure 6:
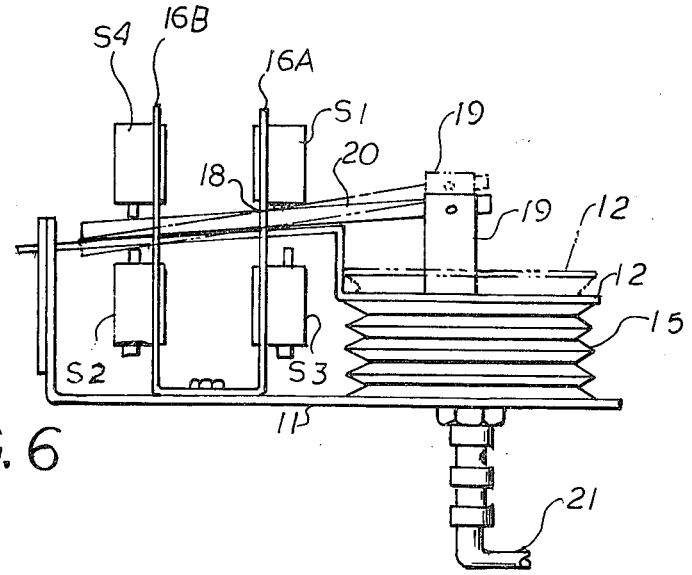
FIG. 6 is a side elevation view of the control device illustrating a first and second positive pressure position.
Figure 7:
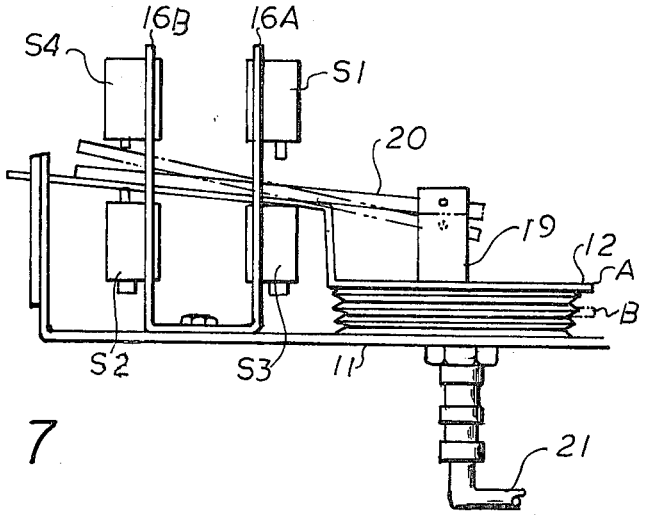
FIG. 7 is a side elevation view similar to that of FIG. 6 illustrating a first and second negative pressure position.

Referring to FIGS. 1, 6 and 7, the operation of the control device is as follows:

In the neutral position as seen in FIG. 1, the actuating arm 20 is centered in opening 18, 18 and the switch plungers 17 are in an inoperative position. As shown $S_1$ is a soft blow switch, $S_2$ is a hard blow switch. Conversely, $S_3$ and $S_4$ are soft suck and hard suck switches respectively.

If one softly blows into hose 21, the bellows is expanded to a first position as shown by the solid line showing in FIG. 6. In this position, the actuating arm is displaced so that the soft positive pressure switch $S_1$ is actuated. In this position, the plunger 17 of switch $S_2$ acts as fulcrum for actuating arm to produce a 2:1 mechanical advantage for for the bellows 15 with respect to switch $S_1$. When switch $S_1$ is actuated, the actuating arm engages the edge of the opening 18 in arm 16A whereby the edge of hole 18 in arm 16A becomes the fulcrum for continued displacement of the actuating arm 20. The arragement is such that greater positive pressure is required to activate switch $S_2$ since the shifting of the fulcrum for the actuating arm reduces the mechanical advantage to 1:1. Thus, upon blowing hard on hose 21, the bellows 15 is expanded to the dotted line position to activate the hard blow switch $S_2$.

Conversely, when a soft suck or first negative pressure position is imparted on the bellows 15 to cause it to contract to a first position A as seen in FIG. 7, plunger 17 of switch $S_3$ becomes the fulcrum of the actuating arm 20 to produce a 2:1 mechanical advantage in actuating the soft blow switch $S_3$. When switch $S_4$ is actuated, the actuating arm engages the upper edge of hole 18 in arm 16B so that this edge now becomes the fulcrum for any continued displacement of the actuating arm 20. Because of the shifting of the fulcrum as described, the mechanical advantage of the arm in effecting the actuating of switch $S_3$ has been reduced to 1:1. Thus a greater negative pressure or hard suck is required to be imparted on the bellows to effect displacement thereof of a sufficient amount for the actuating arm 20 to activate the hard suck switch $S_3$.

With the control device described it will be noted that the arrangement is such that a definite positive displacement of the actuating arm 20 can be effected to distinguish between a soft and hard blow and a soft and hard suck so as to control a mechanical aid accordingly.

While the invention has been described with respect to a particular embodiment thereof, it will be appreciated and understood that variations and modifications may be made without departing from the spirit or scope of the invention.

I claim:

1. A positive and negative pressure sensitive switching device comprising a base member, a pivot lever, pivot means pivotally mounting said pivot lever to said base, expandible chamber means interconnected between said base member and said pivot lever, said chamber means being expanded when subjected to a positive pressure and being contracted under negative pressure whereby said pivot lever is displaced about said pivot means accordingly, switch means mounted on said base member, said switch means including at least a pair of switches, an actuating arm, means pivotally connecting said actuating arm on said pivot lever, said actuating arm operating one of said switches when said chamber means is expanded under positive pressure, and whereby said actuating arm operates another of said switches when said chamber means is contracted under a negative pressure.

2. A device as in claim 1 wherein said switch means comprises two pairs of switches, each pair of switches including a first switch and a second switch.

3. A device as in claim 2 and including means for varying the mechanical advantage of said actuating arm in operating on said first and second switch of each of said pair of switches.

4. A device as in claim 3 wherein said last mentioned means comprises fulcrum means disposed between the ends of said actuating arm and defining a pivot thereof for decreasing the mechanical advantage of said arm in actuating the second switch of said respective pair of switches.

5. A positive and negative pressure sensitive switching device comprising a base member, a pivoting lever, pivot means pivotally connecting said pivoting lever to said base member, expandible chamber means interconnected between said base member and said pivoting lever, means for selectively subjecting said chamber means to positive and negative pressures whereby said chamber means is expanded under positive pressure and contracted under negative pressure to thereby effect displacement of said pivoting lever accordingly, a bracket mounted on said base member, said bracket having an opening therein, an actuating arm, means pivoting one end of said actuating arm on said pivoting lever, the other end of said actuating arm extending through the opening in said bracket, at least two pairs of switches mounted on said bracket with a pair of switches disposed to either side of said actuating arm, one pair of said switches being selectively actuated when said chamber means is subjected to a first or a second positive pressure, and whereby the other pair of said switches are selectively actuated when said chamber means is subjected to a first or second negative pressure.

6. A pneumatic switching device comprising a base member, a pivot lever, pivot means pivotally connecting said pivot lever to said base member, expandible chamber means interconnected between said base member and said pivot lever, said chamber being subjected to a negative and positive pressure, switch means mounted on said base member, said switch means comprising at least two pairs of switches, an actuating arm, pivot means connecting said actuating arm to said pivot lever, said actuating arm selectively operates on one pair of said switches in a first and second position of said expandible chamber means when subjected to a positive pressure and selectively operating the other pair of said switches in a first and second position of said expandible chamber means when subjected to a negative pressure.

7. A positive and negative pressure sensitive switching device comprising a base member, a pivot lever pivoted at one end thereof to said base member, expandible and contractable chamber means interconnected between said base member and said pivot lever, wherein said chamber means is expanded when subjected to a positive pressure and contracted when subjected to a negative pressure to thereby effect displacement of said pivot lever relative to said base member accordingly, an actuating arm, means pivotally connecting said actuating arm on said pivot lever, two pairs of switches, one pair being disposed on opposite sides of said actuating arm, each of said pairs of switches including a positive pressure sensitive switch and a negative pressure sensitive switch, fulcrum means for said actuating arm located between the ends of said actuating arm and between said positive and negative pressure switches, whereby the positive pressure sensitive switch on one side of said pivot lever is actuated under a predetermined mechanical advantage when the chamber means is expanded to one position and whereby the positive pressure sensitive switch on the other side of the actuating arm is actuated with a lesser mechanical advantage when said chamber means is expanded to another position and whereby said negative pressure sensitive switches are similarly actuated in converse manner when said chamber means is subjected to negative pressures to assume one position and another position.

8. A device as in claim 7 wherein said switches each include a depressible operating member, whereby the operating member of one switch functions as a fulcrum means for said actuating arm in the one position of said chamber means and whereby said fulcrum means defines the fulcrum for said actuating arm operating on the other switch in the other position of said chamber means.

* * * * *